US007764002B2

(12) United States Patent
Yu et al.

(10) Patent No.: US 7,764,002 B2
(45) Date of Patent: Jul. 27, 2010

(54) COMBINATION TYPE SLIP RING

(75) Inventors: Meng-Chiu Yu, Taichung (TW); Su-Chen Liao, Taichung (TW)

(73) Assignee: Taiwan Long Hawn Enterprise Co., Taichung (TW)

( * ) Notice: Subject to any disclaimer, the term of this patent is extended or adjusted under 35 U.S.C. 154(b) by 0 days.

(21) Appl. No.: 12/246,168

(22) Filed: Oct. 6, 2008

(65) Prior Publication Data

US 2009/0124098 A1 May 14, 2009

(30) Foreign Application Priority Data

Oct. 5, 2007 (TW) ..... 96216751 A

(51) Int. Cl.
*H01R 39/08* (2006.01)

(52) U.S. Cl. ..... 310/232; 439/23

(58) Field of Classification Search ..... 310/232; 439/20, 23–24, 28; 29/597
See application file for complete search history.

(56) References Cited

U.S. PATENT DOCUMENTS 1,493,859 A * 5/1924 Himes ..... 310/232
1,731,892 A * 10/1929 Ferris ..... 310/232
1,870,236 A * 8/1932 Chervenka ..... 310/232
2,696,570 A * 12/1954 Pandapas ..... 310/232
3,636,394 A * 1/1972 Forste et al. ..... 310/232
3,686,514 A * 8/1972 Dube et al. ..... 310/232
3,688,142 A * 8/1972 Forste et al. ..... 310/232
4,406,961 A * 9/1983 Pfluger et al. ..... 310/232

FOREIGN PATENT DOCUMENTS

JP 2003-45600 * 2/2003

* cited by examiner

*Primary Examiner*—Burton Mullins
(74) *Attorney, Agent, or Firm*—Browdy and Neimark, PLLC

(57) ABSTRACT

A combination type slip ring includes a base, a plurality of conductive members, conductive rings, and insulating rings. Each of the conductive members has a slot for connection of the conductive members respectively. Each of the insulating rings has an axial hole at a center thereof, and a plurality of bores and a slot around the axial hole. The conductive rings are fitted to the insulating rings in sequence with the conductive members received in the slots and the insulating rings passing through the corresponding bores of other insulating rings that the conductive members have distal ends thereof out of said insulating ring.

10 Claims, 5 Drawing Sheets

COMBINATION TYPE SLIP RING

BACKGROUND OF THE INVENTION

1. Field of the Invention

The present invention relates generally to a slip ring, and more particularly to a combination type slip ring.

2. Description of the Related Art

Typically, a conventional slip ring includes a metal tubular member and several conductive rings fitted thereon. The conductive rings are insulated from each other. A conventional method of assembling the slip ring is that the conductive rings are fitted to metal tubular member, and then they are put in a mold for an insert molding process for fixing the metal tubular member and the conductive rings.

Because of the insert molding process, the diameter, thickness, and numbers of the conductive rings are limited by the mold. In other words, the specifications of the conventional slip rings can't be customized.

SUMMARY OF THE INVENTION

The primary objective of the present invention is to provide a combination type slip ring, which has a wide rang variety in specifications for totally customization.

According to the objective of the present invention, a combination type slip ring includes a base, a plurality of conductive members, conductive rings, and insulating ring. The base has at least a slot on a circumference thereof. The conductive rings are as many as the conductive members, each of which has a slot for insertion of the conductive members. The insulating rings are as many as the conductive rings, each of which has a fitting portion and a spacing portion projected from an outer side of the fitting portion respectively. Each of the fitting portions has an axial hole at a center thereof, and a plurality of bores and a slot around the axial hole. The conductive rings with the conductive members are fitted to the fitting portions of the insulating portion respectively with the conductive members inserted into the bores of the insulating ring. The insulating rings with the conductive rings and the conductive members are fitted to the base in sequence with the conductive members received in the slots of the insulating rings passing through the corresponding bores of the insulating rings to have distal ends thereof out of the insulating ring.

DETAILED DESCRIPTION OF THE INVENTION

Figure 1:
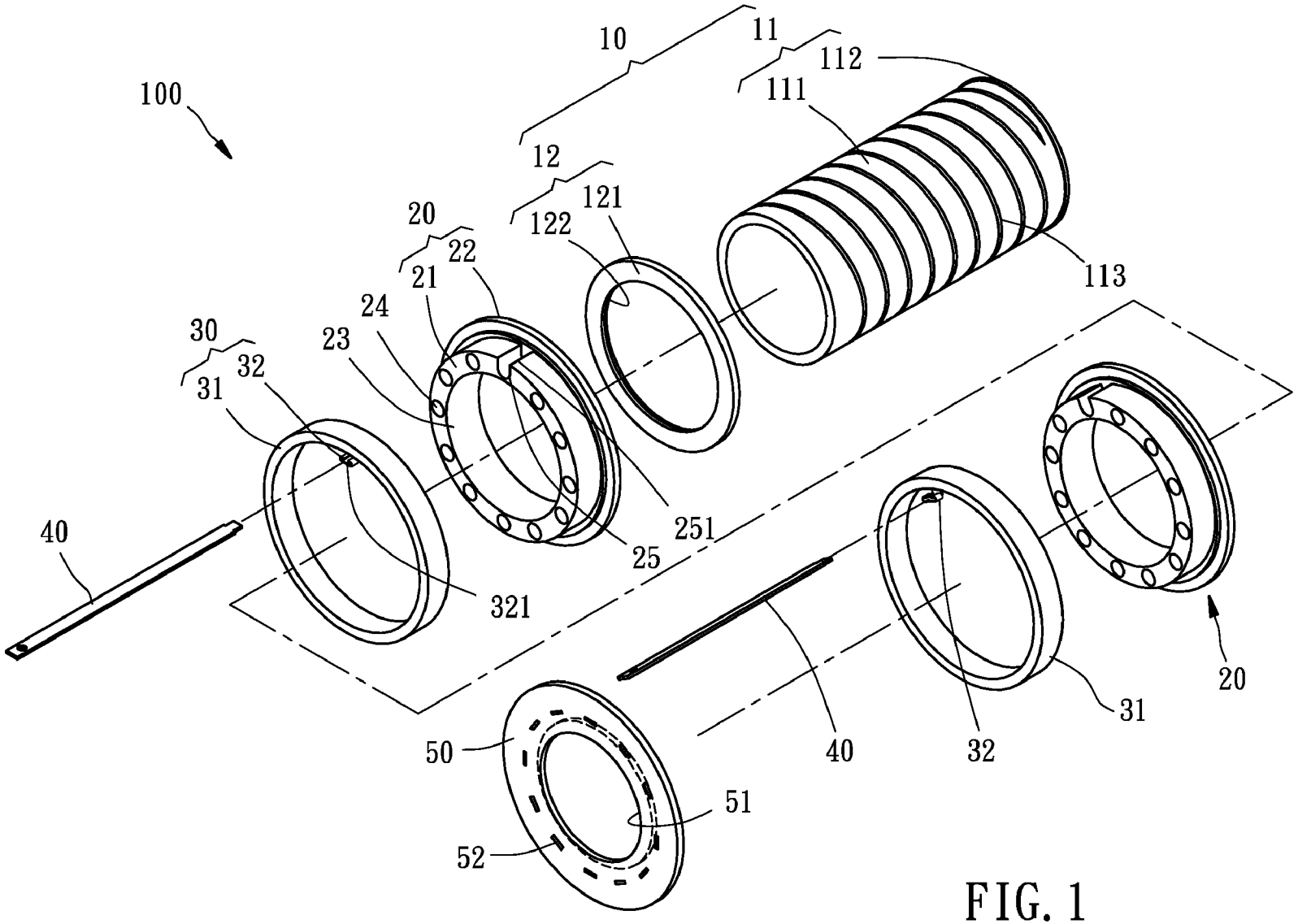
FIG. 1 is an exploded view of a preferred embodiment of the present invention.
Figure 2:
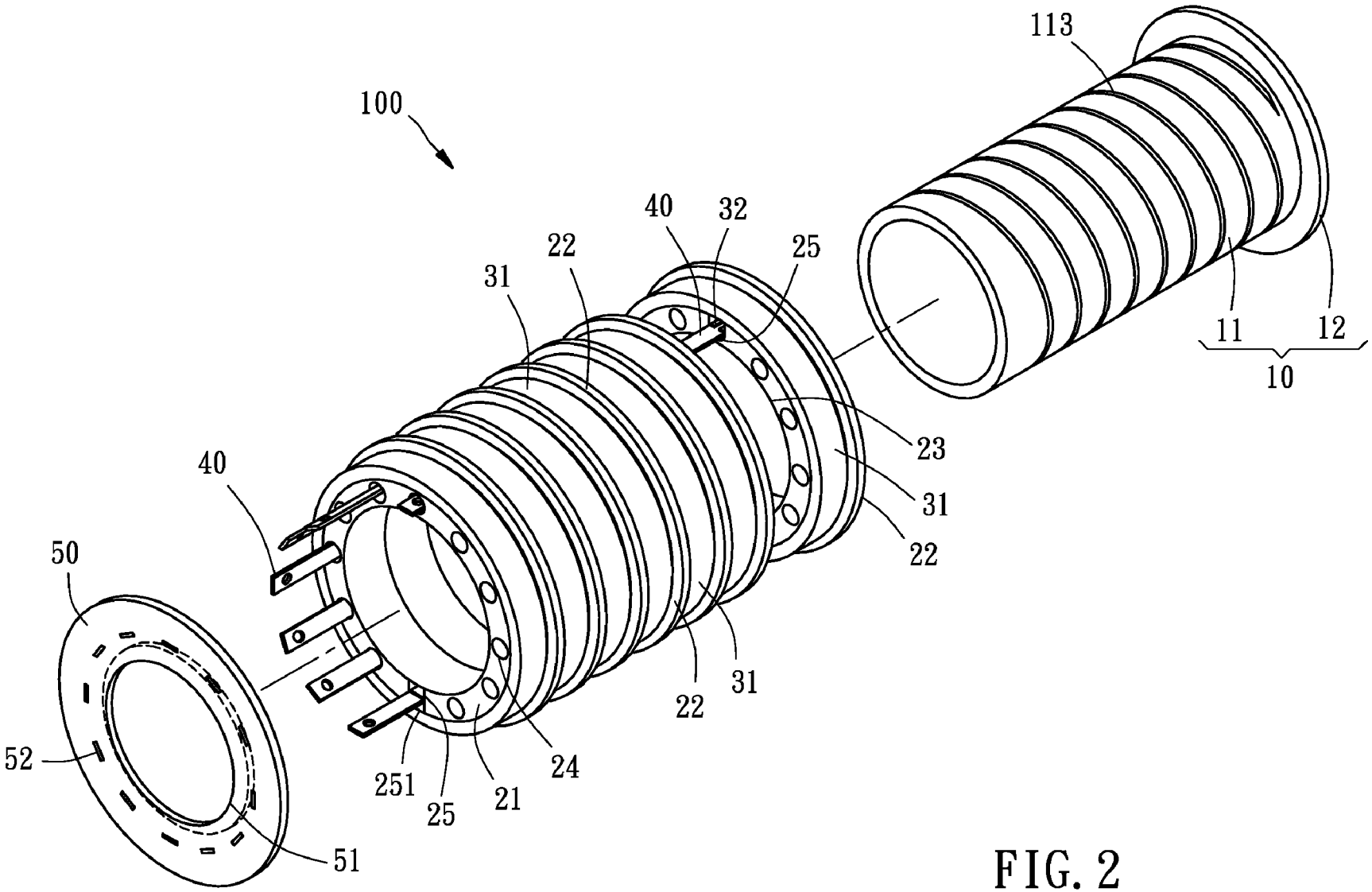
FIG. 2 is an exploded view of a part of FIG. 1.
Figure 3:
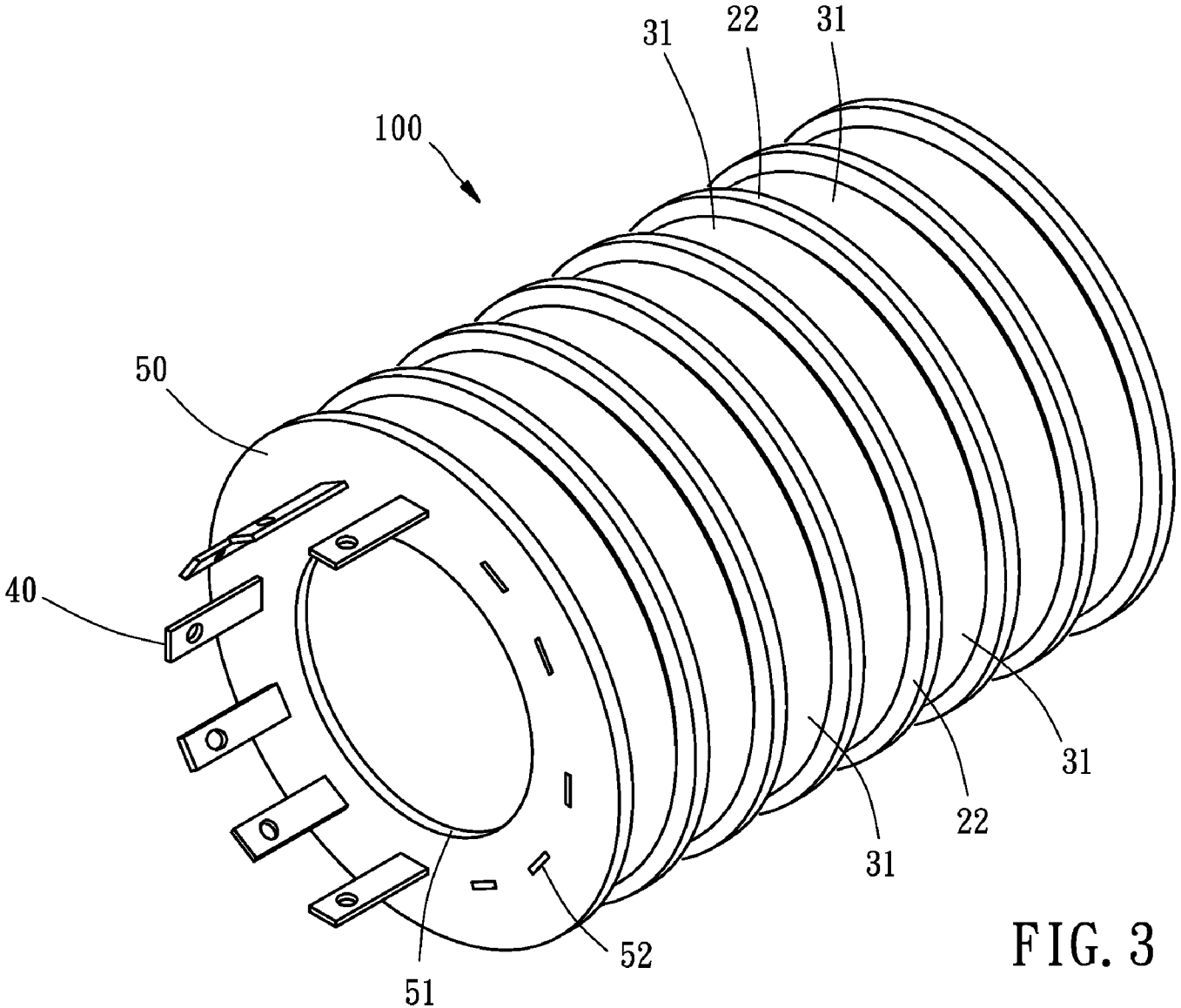
FIG. 3 is a perspective view of FIG. 1.
Figure 4:
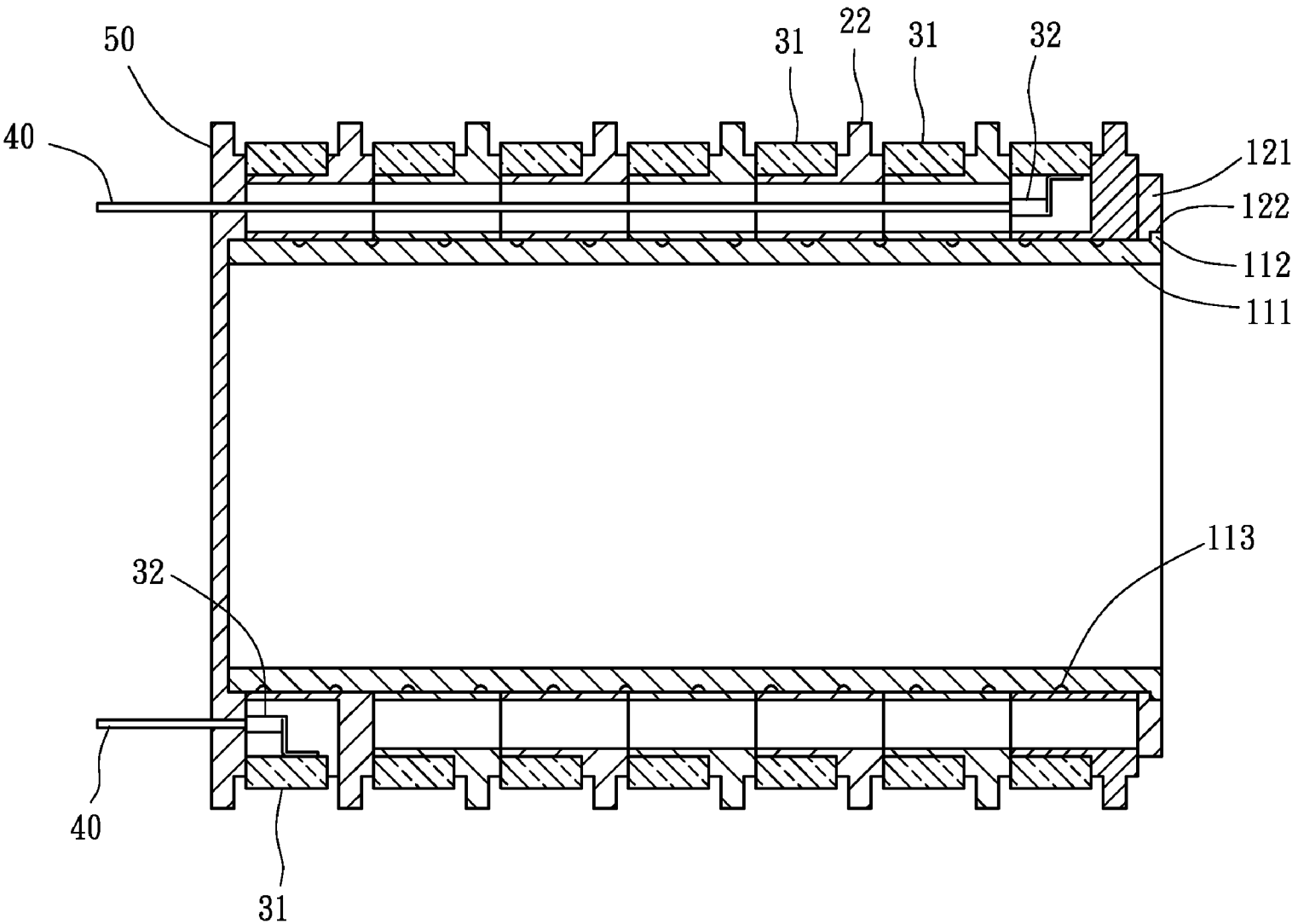
FIG. 4 is a sectional view of FIG. 1.

As shown in FIG. 1 to FIG. 4, a combination type slip ring 100 of the preferred embodiment of the present invention includes a base 10, a plurality of insulating rings 20, a plurality of conductive rings 30, a plurality of conductive members 40, and an insulating lid 50.

The base 10 has a hollow, round metal tubular member 11 and a restricting ring 12. The tubular member 11 has a body portion 111 and a head portion 112 at an end of the body portion 111 and having a diameter greater than the body portion 111. On the body portion 111 includes a spiral slot 113. The restricting ring 12 has a ring member 121 and a slot 122 on an interior side of the ring member 121. An inner diameter of the ring member 121 is greater than that of the slot 122. The restricting ring 12 is fitted to the tubular member 11 that the head portion 113 of the tubular member 11 is engaged with the slot 122 of the restricting ring 12, and the restricting ring 12 is even with the end of the tubular member 11.

The insulating rings 20 are made of an insulating material, each of which has a fitting portion 21 and a spacing portion 22 projected from a circumference of the fitting portion 21. An outer diameter of the spacing portion 22 is greater than that of the fitting portion 21. The insulating ring 20 has an axial hole 23 at a center of the fitting portion 21. On the circumference of the fitting portion 21 has a plurality of through holes 24 and a slot 25. The through holes 24 and the slot 25 have the same intervals therebetween. The slot 25 has an opening 251 at an outer side thereof.

A number of the conductive rings 30 is as same as the insulating rings 20. Each of the conductive rings 30 has a conductive ring member 31 at a socket 32. Inner diameters of the ring members 31 are identical to or slightly greater than outer diameters of the fitting portions 21 of the insulating rings 20. The socket 32 is mounted on an interior side of the ring member 31 having a slot 321 facing inward.

A number of the conductive members 40 is as same as the conductive rings 30. The conductive members 40 are metal plates having various lengths.

The insulating lid 50 is made of an insulating material having a through hole 51 at a center thereof and a plurality of bores 52 around the through holes 51.

The elements of the combination type slip ring 100 of the present invention have been described. The way of assembling and the characters of the present invention will be described in following:

First, ends of the conductive members 40 are inserted into the slots 321 of the conductive rings 30 respectively, and then the conductive rings 30 are fitted to the fitting portions 21 of the insulating rings 20 respectively with the sockets 32 of the conductive rings 30 inserted into the corresponding slots 25 of the insulating rings 20 via the openings 251 respectively. And then, the insulating rings 20, with the conductive rings 30 thereon, is fitted to the body portion 111 of the tubular member 11 of the base 10 in sequence. The fitting order is that the insulating ring having the longest conductive member is that first, and the insulating ring having the shortest conductive member is last. The insulating ring 20, which is the first one fitted to the body portion 111 of the tubular member 11, has the spacing portion 22 touching the restricting ring 12. The conductive rings 30 are spaced from each other by the insulating rings 20. The conductive members 40 pass through the corresponding through holes 24 of the insulating rings 20 and have the same lengths out of the through holes 24. At last, the insulating lid 50 is put on the outer insulating ring 20 on the base 10 with the conductive members 40 passing through the bores 52.

To have a firmer structure of the insulating rings 20 and the base 10, an adhesive (not shown, which may be epoxy) is coated in the slot 113 of the base 10. The adhesive may flow through the entire spiral slot 113 to bond the insulating rings 20 to the tubular member 11 of the base 10 firmly. The adhesive may be injected into the through holes 24 of the insulating rings 20 respectively to bond the insulating rings 20 in series.

Above are the elements and a way of assembling the combination type slip ring 100 of the present invention. In the following, we will describe the characters of the present invention.

The combination type slip ring 100 of the present invention provides insulating rings 20 fitted to the base 10. No insert molding is involved in the present invention so that the number of the conductive rings 30 is a decision of designer as long as the base 10 and the conductive members 40 have sufficient lengths. As a result, the specifications of the combination type slip ring 100 of the present invention are various in a wide range to meet any client's requirement.

Figure 5:
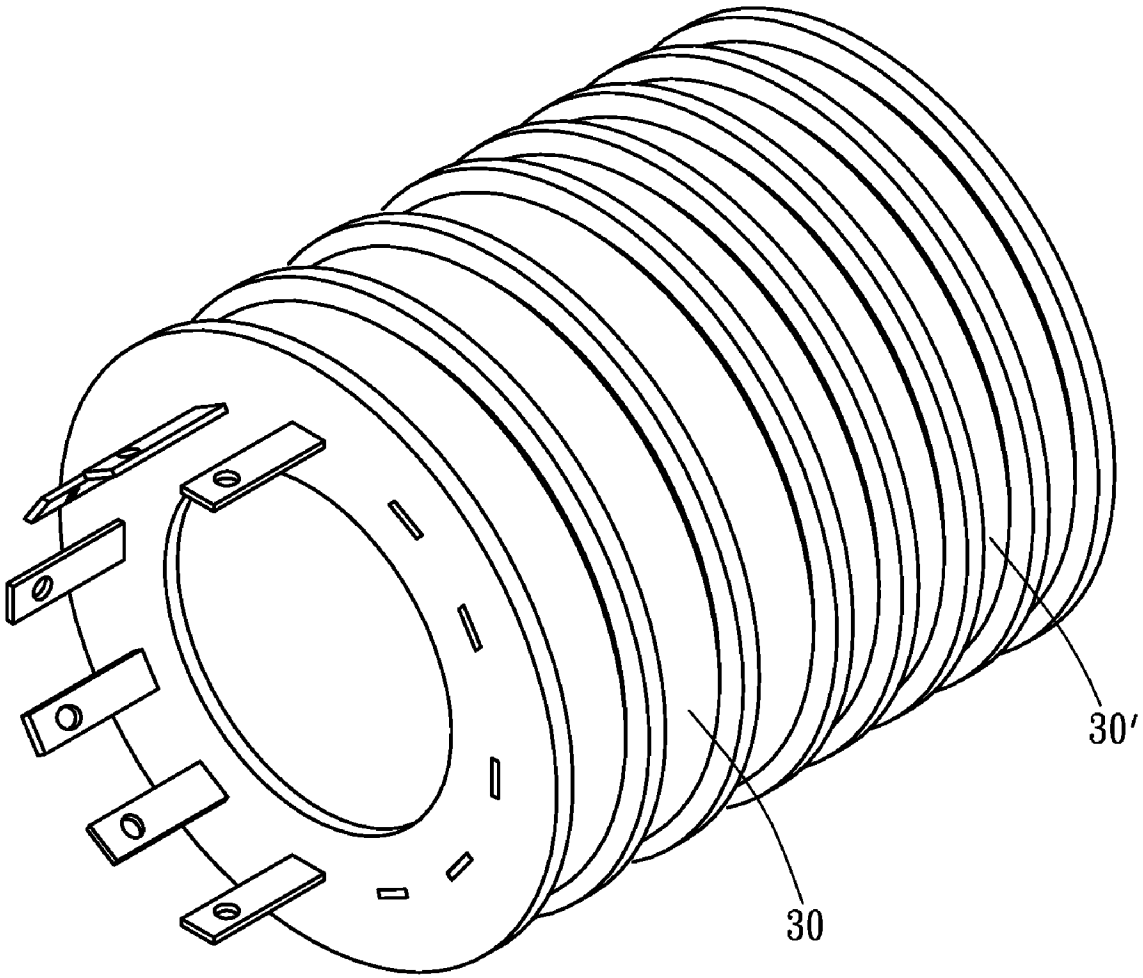
FIG. 5 is a perspective view of another preferred embodiment of the present invention.

Besides the number of the conductive rings 30 has a wide variety, thicknesses of the conductive rings 30 may be changed as well. FIG. 5 shows another combination type slip ring of the present invention having thicker conductive rings 30 and thinner conductive rings 30'. It is easy to understand that the diameters of the conductive rings 30 may be changed also with the suitable base, insulating rings, and conductive members. As a result, the combination type slip ring 100 of the present invention has a wide range variety that may be adjusted according to the client's requirement to achieve the objective of customization.

The description above is a few preferred embodiments of the present invention and the equivalence of the present invention is still in the scope of the claim of the present invention.

What is claimed is:

1. A combination type slip ring, comprising:

a base having at least a slot on a circumference thereof;

a plurality of conductive members;

a plurality of conductive rings, which are as many as said conductive members, having a slot respectively for insertion of said conductive members; and a plurality of insulating rings, which are as many as said conductive rings, having a fitting portion and a spacing portion projected from an outer side of said fitting portion respectively, wherein each of said fitting portions has an axial hole at a center thereof, and a plurality of bores and a slot around said axial hole, and said conductive rings with said conductive members are fitted to said fitting portions of said insulating portion respectively with said conductive members inserted into said bores of said insulating ring; further wherein said insulating rings with said conductive rings and said conductive members are fitted to said base in sequence with said conductive members received in said slots of said insulating rings passing through said corresponding bores of said insulating rings to have distal ends thereof out of said insulating ring.

2. The combination type slip ring as defined in claim 1, wherein said base has a tubular member and a restricting ring on a circumference of said tubular member that said restricting ring touch said insulating ring, and said slot is formed on said circumference of said tubular member.

3. The combination type slip ring as defined in claim 2, wherein said tubular member has a body portion and a head portion having a diameter greater than that of said body portion, and said restricting ring has a ring member and a slot on an interior side of said ring member whereby said restricting ring is fitted to said tubular member with said head portion of said tubular member engaged with said slot of said restricting ring that said restricting ring is even with an end of said tubular member.

4. The combination type slip ring as defined in claim 1, wherein said slot of said base is a spiral slot.

5. The combination type slip ring as defined in claim 1, wherein each of said insulating rings has the axial hole through said sitting portion for fitting said insulating ring to said base.

6. The combination type slip ring as defined in claim 1, wherein each of slots of said insulating rings has an opening facing outwardly, and said conductive members enter said slots of said insulating rings via said openings respectively.

7. The combination type slip ring as defined in claim 1, wherein each of said conductive rings has a ring member and a socket, on which said slot is provided, mounted on an interior side of said ring member.

8. The combination type slip ring as defined in claim 1, wherein said conductive members have different lengths that lengths said conductive members left out of said insulating ring are the same.

9. The combination type slip ring as defined in claim 1, further comprising an insulating lid provided on said outer insulating ring, wherein said insulating lid has a through hole at a center thereof and a plurality of bores around said through hole for said conductive members passing through respectively.

10. The combination type slip ring as defined in claim 1, wherein said slot and said through hole are coated with an adhesive.

* * * * *